US009120330B1

(12) United States Patent
Nakamura

(10) Patent No.: US 9,120,330 B1
(45) Date of Patent: Sep. 1, 2015

(54) RECORDING MEDIUM, PRINT DATA PROCESSING METHOD, AND LABEL PRODUCING APPARATUS

(71) Applicant: Brother Kogyo Kabushiki Kaisha, Nagoya-shi, Aichi-ken (JP)

(72) Inventor: Kenichi Nakamura, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/587,083

(22) Filed: Dec. 31, 2014

(30) Foreign Application Priority Data

Mar. 10, 2014 (JP) ..... 2014-046671

(51) Int. Cl.

| | |
|---|---|
| ***B41J 2/00*** | (2006.01) |
| ***B41J 2/325*** | (2006.01) |
| ***B41J 11/00*** | (2006.01) |
| ***B41J 3/407*** | (2006.01) |
| ***B41J 11/66*** | (2006.01) |

(52) U.S. Cl.
CPC ..... *B41J 3/4075* (2013.01); *B41J 11/663* (2013.01)

(58) Field of Classification Search
USPC ..... 347/171–178, 212–215, 218, 222, 110, 347/16; 400/621, 621.1, 124.11, 611; 83/166, 614, 922
See application file for complete search history.

(56) References Cited

U.S. PATENT DOCUMENTS

| | | | | |
|---|---|---|---|---|
| 5,159,350 | A * | 10/1992 | Minaminaka | 347/218 |
| 6,215,508 | B1 * | 4/2001 | Bryan et al. | 347/171 |
| 8,562,229 | B2 * | 10/2013 | Inaba et al. | 400/621 |
| 8,888,388 | B2 * | 11/2014 | Mochida et al. | 400/621 |
| 8,911,166 | B2 * | 12/2014 | Tsukada | 400/621 |
| 2006/0082637 | A1 * | 4/2006 | Sanbongi et al. | 347/213 |
| 2008/0231898 | A1 | 9/2008 | Iwanaga et al. | |

FOREIGN PATENT DOCUMENTS

| | | | |
|---|---|---|---|
| JP | 2002-226127 | A | 8/2002 |
| JP | 2008-234481 | A | 10/2008 |
| JP | 2012-139953 | A | 7/2012 |

* cited by examiner

*Primary Examiner* — Kristal Feggins
(74) *Attorney, Agent, or Firm* — Banner & Witcoff, Ltd.

(57) ABSTRACT

The disclosure discloses a non-transitory computer-readable recording medium storing a print data processing program for executing steps comprising a primary print data acquiring step, a secondary print data generating step, a cut command generating step, and a data and command outputting step. In the primary print data acquiring step, primary print data is acquired. The primary print data includes a first dot pattern indicating desired print contents, and a second dot pattern indicating a cutting movement timing. In the secondary print data generating step, the first dot pattern has been extracted and then second print data is newly generated. In the cut command generating step, a cut command corresponding to the cutting movement timing indicated by the second dot pattern is generated. In the data and command outputting step, the cut command is added to the second print data and outputted to a label producing part.

7 Claims, 8 Drawing Sheets

RECORDING MEDIUM, PRINT DATA PROCESSING METHOD, AND LABEL PRODUCING APPARATUS

CROSS-REFERENCE TO RELATED APPLICATION

The present application claims priority from Japanese Patent Application No. 2014-046671, which was filed on Mar. 10, 2014, the disclosure of which is incorporated herein by reference in its entirety.

BACKGROUND

1. Field

The present disclosure relates to a recording medium, a print data processing method, and a label producing apparatus.

2. Description of the Related Art

Conventionally, there are print label producing systems (or label producing apparatuses) that produce a desired print label based on an operation from an operation terminal such as a personal computer or an operation of an operation part of a label producing apparatus, for example.

At this time, for example, according to the aforementioned print label producing system, when an operator operates the operation terminal to specify the print contents of the print label (label with adhesive material) that he or she wants to produce, the corresponding print data is transmitted from the operation terminal to the label producing apparatus.

Then, printing corresponding to the print data received by printing means, such as a thermal head included in the label producing apparatus, is executed on a print-receiving medium, such as a laminated film, and the print-receiving medium is cut at a predetermined position, thereby producing the print label.

Hence, the print label is produced by cutting the print-receiving medium such as the laminated film as described above.

Accordingly, in order to produce the print label, cut instruction data for cutting the print-receiving medium at a desired position is required in addition to a print command corresponding to the print itself resulting from the print data.

The cut instruction data is produced based on cutting option information by the operation terminal and added to the printing data, for example.

However, in the aforementioned print label producing system, the cutting option settings need to be performed as an input operation for cutting separately from the print data settings, by operating the personal computer, which serves as the operation terminal, causing the problem of a large operation burden for the user.

That is, normally the print movement of the printing means is controlled by print data that includes a dot pattern indicating the print contents desired by the user, while the cutting movement of the cutting means is controlled by a cut command corresponding to cutting movement timing.

Accordingly, in order to produce one print label, both the print data and cut command need to be respectively prepared in advance by suitable setting input by the user.

As a result, for example, in a case where the user attempts to produce a plurality of print labels all at once, it is not easy to configure settings so that each of the print labels has a different label length, making the user operation more complicated.

SUMMARY

It is therefore an object of the present disclosure to provide a recording medium, a print data processing method, and a label producing apparatus capable of eliminating the need to input settings for the cut command separately from the print data settings, thereby reducing the operation burden of the user.

In order to achieve the above-described object, according to the aspect of the present application, there is provided a non-transitory computer-readable recording medium storing a print data processing program for executing steps on a computing device configured to generate a signal for controlling a label producing part, the label producing part comprising a printing head configured to perform printing on a print-receiving tape, and a cutter configured to at least partially cut the print-receiving tape on which printing has been performed by the printing head in a thickness direction and to produce a print label, the steps comprising a primary print data acquiring step for acquiring primary print data that includes a first dot pattern indicating desired print contents to be formed by the printing head, and a second dot pattern indicating a cutting movement timing corresponding to a cutting location by the cutter, a secondary print data generating step for newly generating second print data wherein the first dot pattern has been extracted from the primary print data acquired in the primary print data acquiring step, a cut command generating step for generating a cut command corresponding to the cutting movement timing indicated by the second dot pattern included in the primary print data acquired in the primary print data acquiring step, and a data and command outputting step for adding the cut command generated in the cut command generating step to the second print data generated in the secondary print data generating step, and for outputting the result to the label producing part.

DETAILED DESCRIPTION OF THE PREFERRED EMBODIMENTS

The following describes an embodiment of the present disclosure with reference to accompanying drawings.

Figure 1:
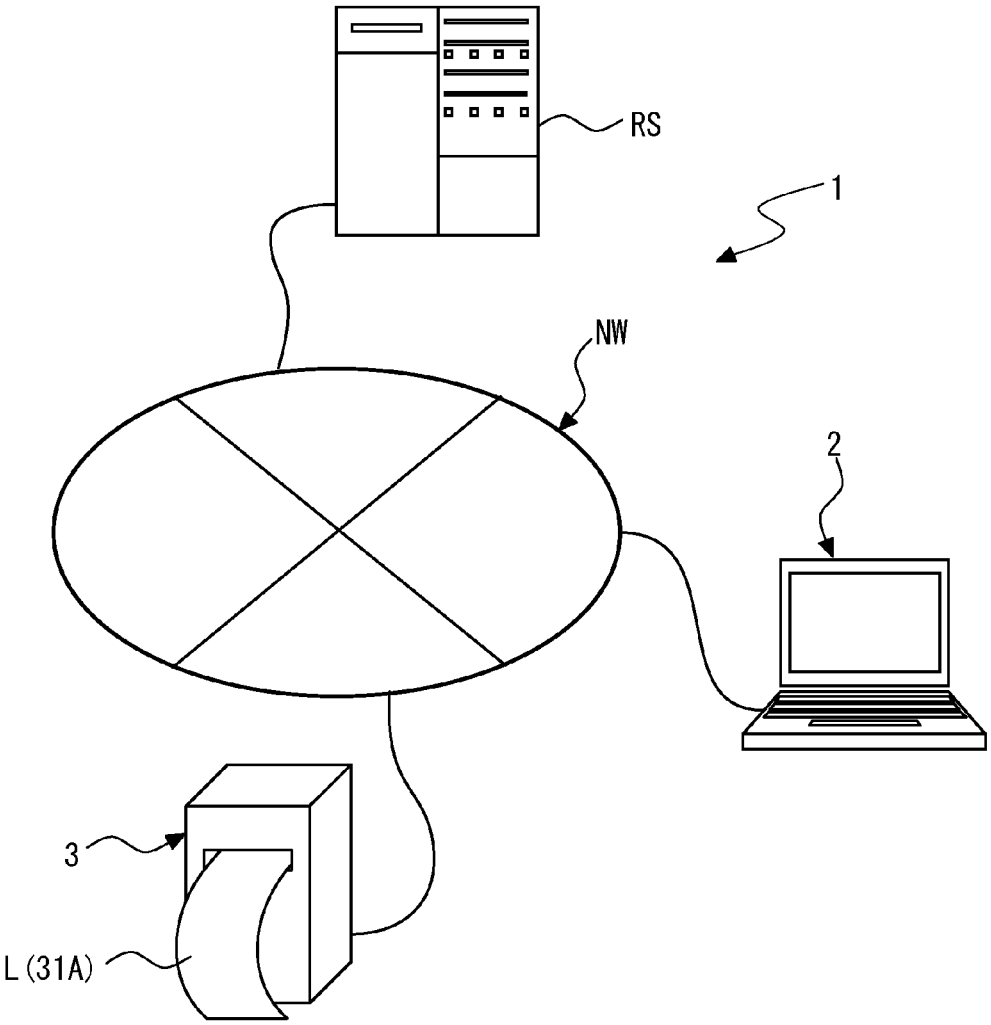
FIG. 1 is an explanatory view showing the overall configuration of the print label producing system comprising an operation terminal for realizing the print data processing program in an embodiment of the present disclosure.

FIG. 1 is an explanatory view showing the overall configuration of a print label producing system for realizing the print data processing program in this embodiment.

In FIG. 1, the print label producing system 1 comprises a server RS, an operation terminal 2 comprising a general-purpose personal computer, for example, and a label producing apparatus 3 connected to the operation terminal 2 via an interface such as a USB. Then, the server RS, the operation terminal 2, and the label producing apparatus 3 are connected to each other via a network NW.

The label producing apparatus 3 transmits and receives various information and instruction signals with the operation terminal 2, and produces a print label L comprising print such as desired characters and graphics, based on print data from the operation terminal.

Figure 2:
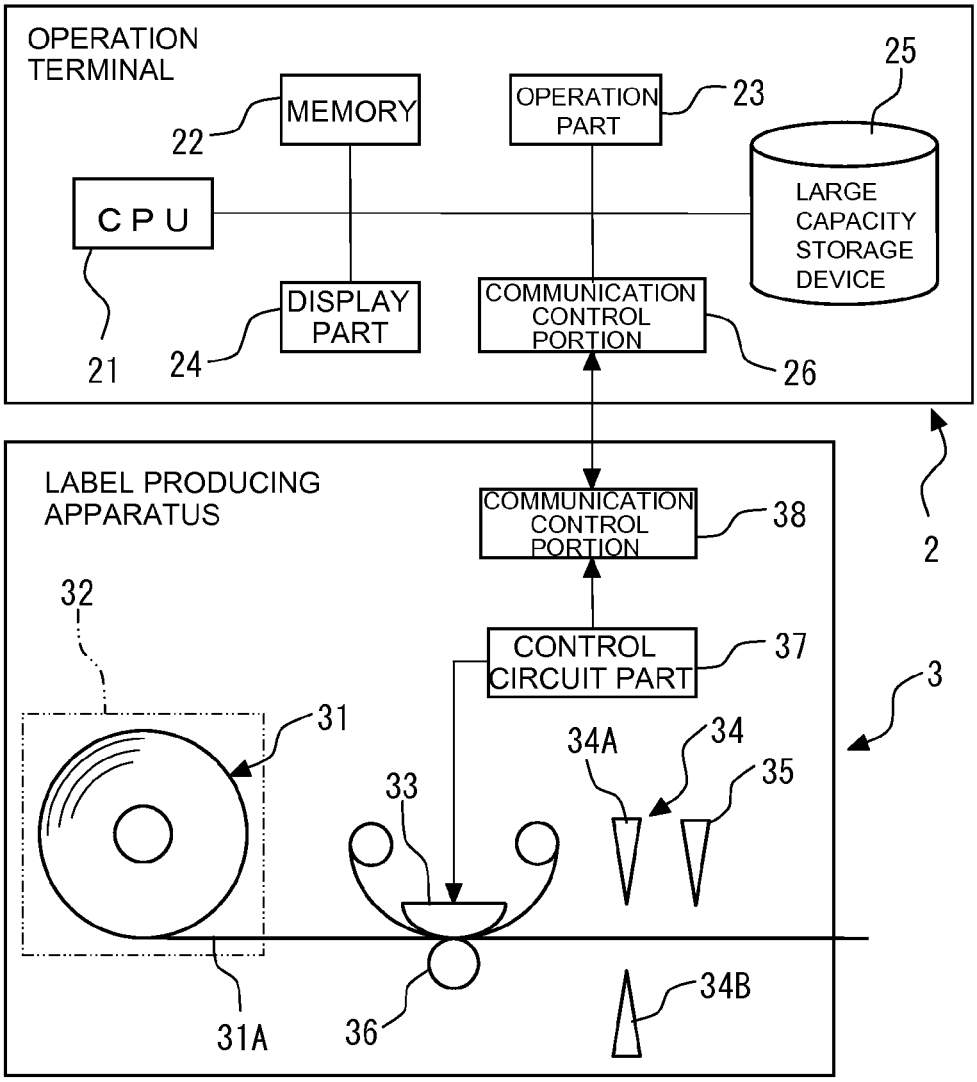
FIG. 2 is a functional block diagram showing the detailed functions of the print data processing program.

FIG. 2 is a functional block diagram showing the detailed functions of the operation terminal 2 and the label producing apparatus 3.

In FIG. 2, the operation terminal 2 comprises a CPU 21, a memory 22 comprising a RAM, ROM, and the like, an operation part 23 such as a keyboard or mouse, by which the user inputs instructions and information, a display part 24 that displays various setting screens such as an editing screen by an application program, which includes the print data processing program of the present disclosure, installed in advance, a large capacity storage device 25 comprising a hard disk device and stores various information, and a communication control portion 26 that performs the control for transmitting and receiving information signals with the label producing apparatus 3 via the network NW.

The CPU 21 performs signal processing in accordance with a program stored in advance in the ROM while utilizing a temporary storage function of the RAM. The CPU 21 transmits and receives various instruction and information signals via the network NW with the label producing apparatus 3 by the above described signal processing.

On the other hand, the label producing apparatus 3 comprises a tape roll holder part 32 capable of attaching and detaching a tape roll 31 (or capable of attaching and detaching a cartridge comprising the tape roll 31) comprising a tape (shown in a simplified manner) 31A as a print-receiving tape wound in a spiral, a printing head 33 that performs desired printing on the tape 31A fed out from the tape roll 31, a full-cutter 34 and a half-cutter 35 as a cutter that cuts the tape 31A on which printing has been completed at a predetermined length to form the print label L, a feeder 36 that feeds out and feeds the tape 31A from the tape roll 31, and a control circuit 37 that controls the driving thereof. Further, the control circuit 37 is connected to the communication control portion 26 of the operation terminal 2 by the network NW via a communication control portion 38, making it possible to transmit and receive information between the operation terminal 2 and the label producing apparatus 3. Note that the print mechanism section of the label producing apparatus 3 that excludes the control circuit 37 and the communication control portion 38 constitutes the label producing part in each of the claims.

In the above described configuration, when producing the print label L in the label producing apparatus 3, the user performs a suitable operation using the operation part 23 based on the application program started using the operation terminal 2, thereby inputting the settings for the characters, graphics, and the like (hereinafter simply referred to as "text input") to be printed on the surface of the print label L.

With this arrangement, print data corresponding to the text input is generated by the CPU 21. Then, the user inputs a production instruction for the print label L by a suitable operation using the operation part 23, thereby transmitting the generated print data from the operation terminal 2 to the control circuit 37 of the label producing apparatus 3. Then, in the label producing apparatus 3, printing by the printing head 33 is performed based on the print data transmitted from the operation terminal 2 and the print label L is produced, by the control of the control circuit 37.

Figure 3:
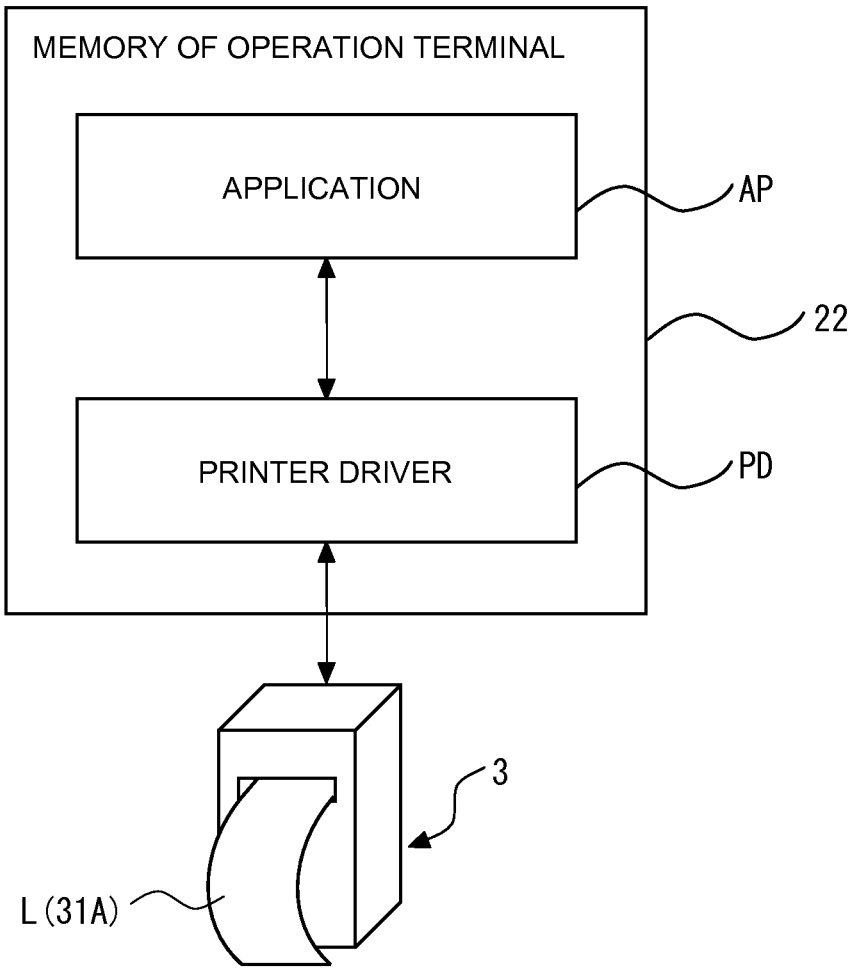
FIG. 3 is a block diagram showing an example of a functional configuration of the process control within the operation terminal.

FIG. 3 is a block diagram showing an example of a functional configuration of the process control within the operation terminal 2.

In FIG. 3, in this example, an application program AP and a printer driver program PD related to the production of the print data associated with the text input by the user are expanded in the memory (RAM) 22 of the operation terminal 2 and started, making it possible to transmit and receive instruction and information signals between the two. The printer driver program PD transmits and receives signals with the label producing apparatus 3 via connection with the communication control portion 26 and the communication control portion 38 by the network NW.

The application program AP includes, for example, a fixed asset management application program for producing the print label L to be affixed to furnishing such as a desk or chair, a nametag management application program for producing the print label L to be carried by a person such as an employee or visitor, and a document management application program for producing the print label L to be affixed to a document file or the like. These application programs set various setting information and generate print data required for producing the print label L, and output a production instruction for the print label L that includes the print data to the printer driver program PD.

The printer driver program PD receives the production instruction for the print label L output from the application program AP, and outputs a corresponding production command to the label producing apparatus 3.

Note that while the application program AP and the printer driver program PD are both executed by one CPU 21 included in the operation terminal 2, they are individually and independently executed by interrupt control by the time sharing of a time sharing system (TSS), for example. Further, the printer driver program PD may be a program that is incorporated in advance in the basic OS of the operation terminal 2 comprising the general-purpose personal computer, or is individually started on the OS in the same manner as other application programs.

The label producing apparatus 3 produces the print label L by the input of the above described production command from the printer driver program PD. That is, printing is performed based on the above described print data included in the production command.

Figure 4A:
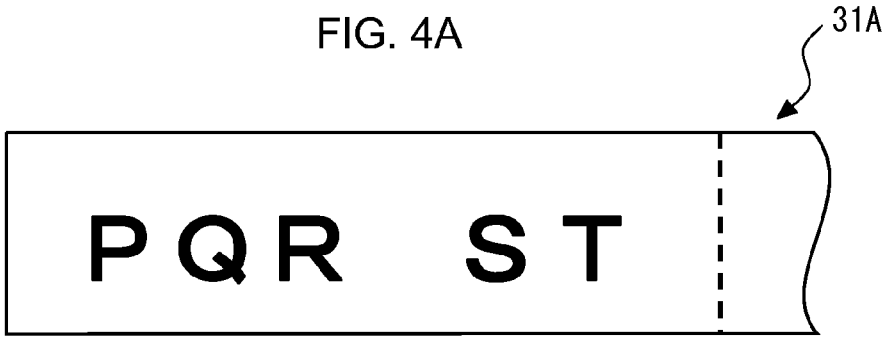
FIG. 4A is a front view of an example of a print label not cut, immediately after printing.

The printing head 33 prints the desired print data on the tape 31A fed based on the driving of the feeder 36, as shown in FIG. 4A, for example. Note that a thermal head comprising a plurality of heating elements that form at least the respective dots on each of the printing lines that divide the tape 31A in the transport direction in terms of a print resolution, arranged in a direction orthogonal to the transport direction of the tape 31A, may be used for the printing head 33.

The tape 31A comprises a layered structure of a plurality of layers (3 layers, for example). That is, the tape 31A comprises, for example, a tape base layer 31*a* made of polyethylene terephthalate or the like, an adhesive layer 31*b* made of a suitable adhesive, and a separation sheet 31*c*, in that order from the inside, which is the winding side, toward the outside in the state of the tape roll 31. Note that, the tape base layer

31*a* comprises a color or a material capable of reflecting light at a sufficiently high reflection rate on the surface.

The separation sheet 31*c* is paper that is peeled when the print label L eventually produced is to be affixed to a target object such as a predetermined article, thereby making it possible to adhere the print label L to the target object by the adhesive layer 31*b*.

Figure 4B:
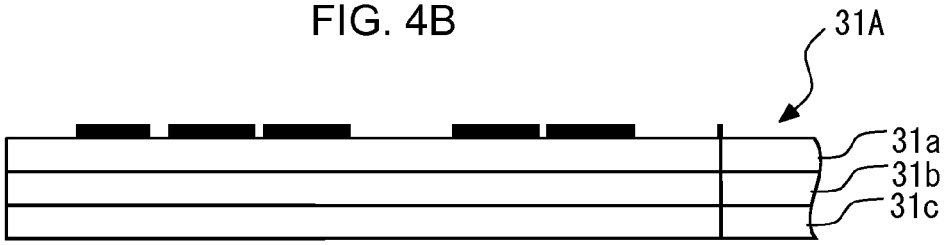
FIG. 4B is a side view of the print label immediately after printing.
Figure 4C:
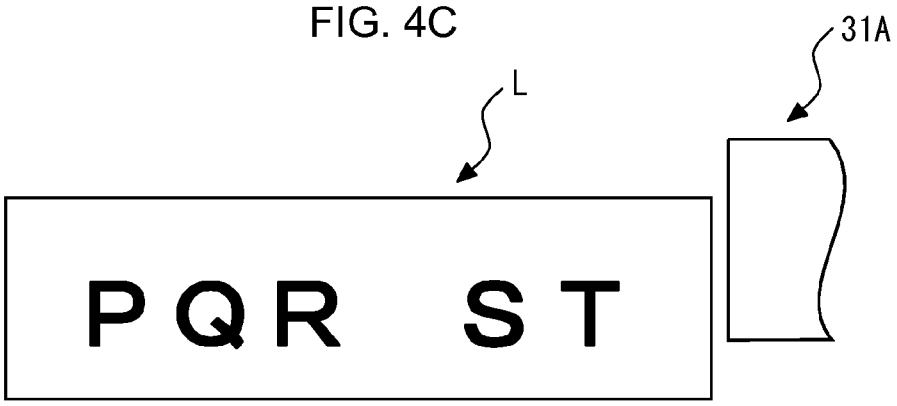
FIG. 4C is a front view of the print label after cutting.

The full-cutter 34, as shown in FIG. 4B and FIG. 4C, is applied in a case where the print label L is to be generated by cutting the tape 31A across the entire thickness, and comprises a movable blade 34A and a fixed blade 34B. The movable blade 34A operates with respect to the fixed blade 34B by a solenoid (not shown), thereby cutting the tape 31A on which printing has been completed by the printing head 33 at a predetermined length.

The half-cutter 35 is applied to a case where the print label L is to be generated (not shown) by cutting the tape base layer 31*a* and the adhesive layer 31*b*, leaving only the separation sheet 31*c*, and operated with respect to the tape 31A by a solenoid (not shown), thereby cutting the tape base layer 31*a* and the adhesive layer 31*b* of the tape 31A on which printing has been completed by the printing head 33, at a predetermined length.

Figure 7A:
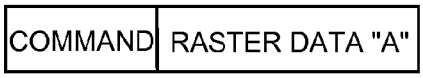
FIG. 7A is an explanatory view of an example of the data format of the printing data generated by the operation terminal in the case of the text character "A,"
Figure 7B:
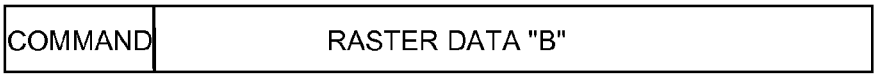
FIG. 7B is an explanatory view of the data format in the case of the text character "B,"
Figure 7C:
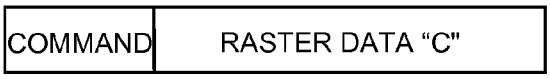
FIG. 7C is an explanatory view of the data format in the case of the text character "C."

Hence, when the user is displaying the editing screen for inputting text characters as described above, the CPU 21 of the operation terminal 2 starts the printer driver program separately. When the cutting positions for producing three print labels based on the text characters "A" "B" and "C" are set, for example, this printer driver program produces three sets of data with the commands for printing (such as the cut command, data length, and initialize command, for example) corresponding to each of the print labels added to the header section of the data format as shown in FIG. 7, that is:

Commands for printing (including cut command)+Raster data "A"

Commands for printing (including cut command)+Raster data "B"

Commands for printing (including cut command)+Raster data "C"

Then, these three sets of data are transmitted to the control circuit 37 of the label producing apparatus 3.

On the other hand, the control circuit 37 of the label producing apparatus 3 respectively generates and outputs the following based on the received three sets of data:

Print-head driving signal for printing "A"+Cutting driving signal

Print-head driving signal for printing "B"+Cutting driving signal

Print-head driving signal for printing "C"+Cutting driving signal

The printing head 33 of the thermal head or the like and the full-cutter 34 are driven, producing the three "A" "B" and "C" print labels L having a predetermined length.

With this arrangement, according to the label producing apparatus 3, it is possible to fully cut the tape 31A across the entire thickness in the thickness direction or partially half cut only the printing tape section of the tape 31A, using the full-cutter 34 or the half-cutter 35, after printing on the tape 31A has been completed and the tape 31A has been feed by a predetermined amount.

In the above basic configuration, the special characteristic of this embodiment lies in that the cut command is automatically generated based on a specific dot pattern, making it possible to set whether or not the print label L is to be cut, the cutting location, and the like by simply inputting the specific dot pattern on the screen for inputting print data using text (that is, on the print contents editing screen for the print label L).

The processing by the print data processing program in this embodiment, executed to achieve the above, will now be described based on FIG. 6. Note that, the following described a case where, as shown in FIG. 5, three print labels L are produced by printing each of the text characters "A" "B" and C" in their entirety on the tape 31A sequentially along the transport direction as a first dot pattern, and fully cutting three locations, namely the locations between the text character "A" and the text character "B," between the text character "B" and the text character "C," and on the transport-direction downstream side of the text character "C."

Figure 5:
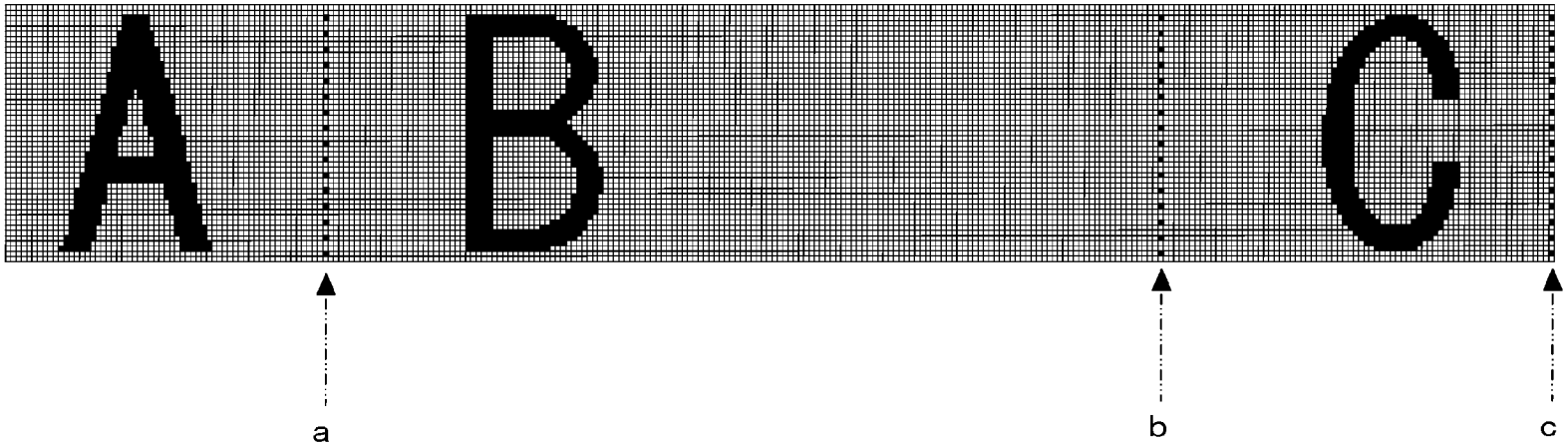
FIG. 5 is an explanatory view showing an example of the outer appearance of the print label on the setting screen.

In this case, the tape 31A is fully cut at positions of different lengths at predetermined timings a, b, c, respectively forming the three print labels "A" "B" and "C." As a result, according to this embodiment, a specific dot pattern (for example, a dotted line having regularity extending in the tape width direction, as in a print-receiving dot □ and a print dot ■ in three dot units: □□■□□■□□■□□■□□■□□■□□■□□■□□■ . . . ) is formed as a second dot pattern on one set of line printing data (a line having a width of one dot), at the positions of the timings a, b, c on a setting screen (preview screen, for example) displaying the tape 31A, as shown in FIG. 5.

As shown, the second dot pattern is a specific dot pattern expressed on one set of line printing data that divides the print data into units of one printing line.

With this arrangement, the user can set whether or not the print label L is to be cut, the cutting location, and the like by simply inputting the above described specific dot pattern indicated on one set of line printing data on the print contents editing screen for the print label L, for example. Further, the specific dot pattern is expressed on the one set of line printing data, making it possible to minimize the effect on the print data (the primary print data described later) related to the print contents of the print label L.

Then, the full-cutter 34 operates using the timing at which the second dot pattern of this specific dot pattern is fed as the cutting movement timing, and cuts the tape 31A. As a result, as shown in FIG. 5, the shortest print label L of "A," the longest print label L of "B," and the print label L of "C" having a length in the middle thereof are respectively generated.

Note that the one dot line direction in the tape width direction shown in FIG. 5 serves as the row direction, and the tape transport direction serves as the column direction. In this case, the combination of the non-print and print dots of one line in the above described first dot pattern and the above described second dot pattern is referred to as raster data. At this time, if the entire one line contains non-print dots, that is, is a blank line, the data is treated as subject to feeding (subject to tape feeding) but not as raster data in printing processing.

Figure 6:
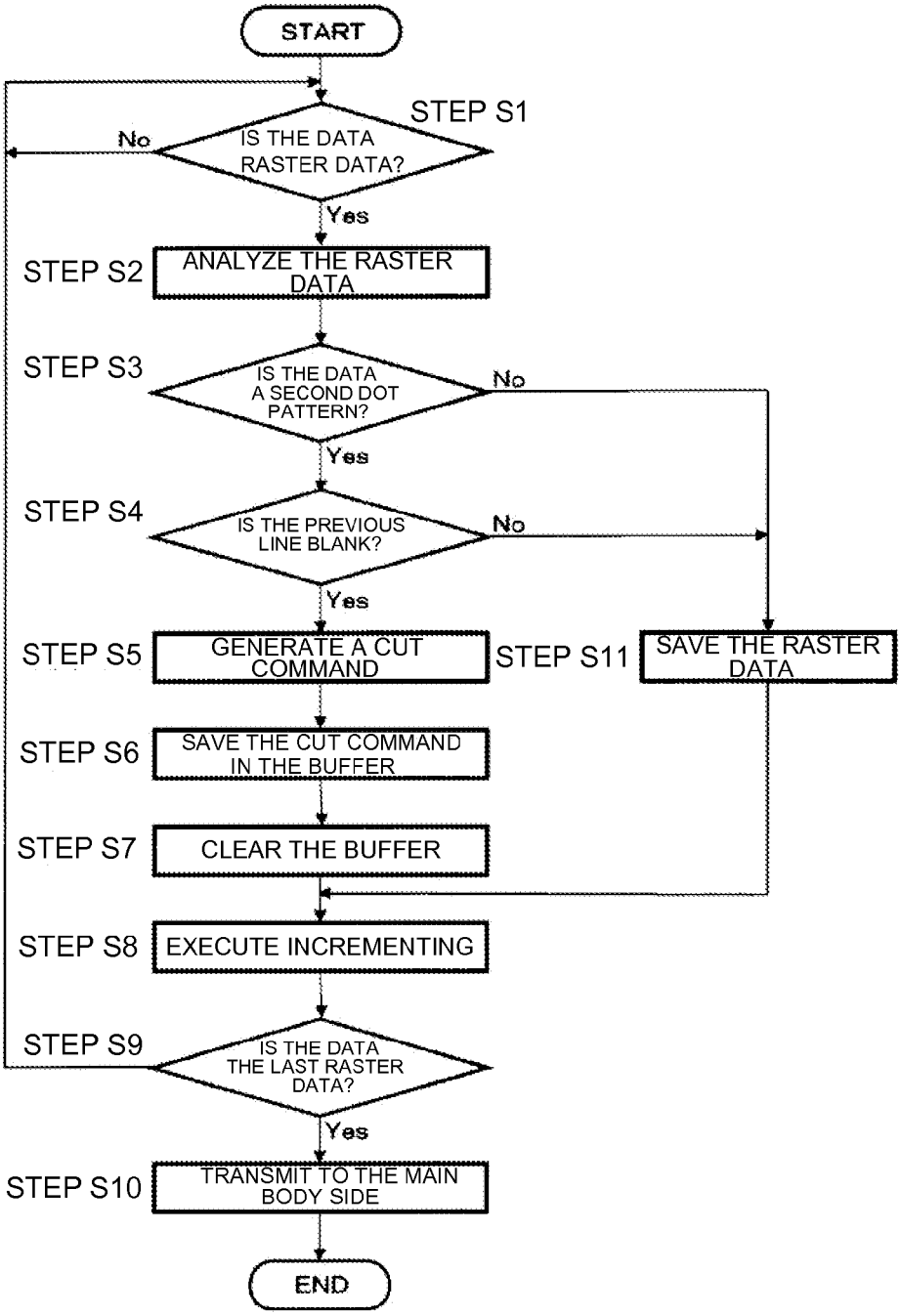
FIG. 6 is a flowchart showing the control procedure executed by the CPU of the operation terminal.

In FIG. 6, first, the CPU 21, in step S1, after print data (equivalent to primary print data) input on the editing screen has been generated by the application program of the operation terminal 2, the CPU 21 determines whether or not the print data of one line expanded in the buffer is raster data in a process for generating the raster data of each line in the printer driver program. That is, the CPU 21 determines whether or not the data is raster data wherein any of the dots of the print data of one line includes dots to be printed. Then, if the CPU 21 determines that the data is raster data (step S1: Yes), the flow proceeds to step S2. On the other hand, if the CPU 21 does not determine that the data is raster data (step S1: No), that is, if the CPU 21 determines that the line is a blank line, the CPU 21 continues to repeat this step S1 and monitor the next and subsequent lines. Note that this step S1 is equivalent to the "primary print data acquiring step" in each of the claims.

Subsequently, the CPU 21, in step S2, analyzes the above described raster data, and the flow proceeds to step S3.

Then, the CPU 21, in step S3, determines whether or not the raster data is the above described second dot pattern corresponding to the cutting option, based on the analytical results of the raster data in the above described step S2. That is, the CPU 21, following the example described above, determines whether or not the configuration of the raster data of one line is, in three dot units: □□■□□■□□■□□■□□■□□■□□■□□■□□■□□■ . . . . Then, if the CPU 21 determines that the raster data is the above described second dot pattern (step S3: Yes), the flow proceeds to step S4. On the other hand, if the CPU 21 does not determine that the raster data is the second dot pattern of the cutting option (step S3: No), the flow proceeds to step S11. Note that this step S3 is equivalent to the "cut timing detecting step" in each of the claims.

Subsequently, if the CPU 21 determines that the current raster data is the second dot pattern of the cutting option (step S3: Yes), the CPU 21, in step S4, determines whether or not the previous one line (or the rearward one line) is a blank line. That is, cases where the dot disposition of one line of a text character is by chance the same as the second dot pattern are presumed and, in such a case, the possibility that the previous line is also raster data is high. Hence, to ensure reliability in cases where the determination result in step S3 indicates that the data is the above described second dot pattern, the CPU 21 makes a determination to confirm whether or not the previous line is raster data or a blank line. Then, if the previous line is a blank line (step S4: Yes), the CPU 21 regards the reliability of the determination result that the data is the second dot pattern in step S3 as high, and the flow proceeds to step S5. On the other hand, if the previous line is not a blank line (step S4: No), the CPU 21 regards the reliability of the determination result in step S3 as low and the data as the first dot pattern rather than the second dot pattern, and the flow proceeds to step S11.

Then, the CPU 21, in step S5, generates a cut command and, in step S6, saves the cut command in the buffer, and the flow proceeds to step S7. Note that the processing routine of the CPU 21 in this step S5 is equivalent to the "cut command generating step" in each of the claims.

Subsequently, the CPU 21, in step S7, clears the data of the one buffer line that was subject to determination in step S1, and the flow proceeds to step S8.

Then, the CPU 21, in step S8, executes the increment processing of one line to move the one line subject to determination in step S1 rearward, and the flow proceeds to step S9.

Subsequently, the CPU 21, in step S9, determines whether or not the one line processed in the above described respective routines is the last line of the printing data and, if the line is the last line (step S9: Yes), the flow proceeds to step S10. On the other hand, if the one line processed in the above described respective routines is not the last line of the printing data (step S9: No), the flow returns to step S1 and the same procedure is repeated thereafter.

Then, the CPU 21, in step S10, regards the determination processing of the raster data of all print data as completed, and transmits the print data to the label producing apparatus 3, completing this routine. Note that the processing routine of the CPU 21 in this step S10 is equivalent to the "data and command outputting step" in each of the claims.

On the other hand, if the conditions in step S3 and step S4 are not satisfied, the CPU 21, in step S11, saves the raster data of the one line, and the flow proceeds to step S8. As a result, the raster data targeting the respective lines and the print data of the blank lines are generated. Note that this step S11 is equivalent to the "secondary print data generating step" in each of the claims.

Next, the control routine of the control circuit 37 of the label producing apparatus 3 based on the print data received via the above described routine will be described based on the flowchart in FIG. 8.

First, the control circuit 37, in step S21, inputs the print data transmitted in the above described step S10.

Subsequently, the control circuit 37, in step S22, drives the feeder 36 and starts feeding the tape 31A.

Then, the control circuit 37, in step S23, determines whether or not the tape 31A has been fed by a predetermined amount. That is, the control circuit 37 determines whether or not the feeding required to cue the start of printing has been performed by a known technique. If the tape 31A has been fed by a predetermined amount (step S23: Yes), the flow proceeds to step S24. If the tape 31A has not been fed by a predetermined amount (step S23: No), the control circuit 37 repeats this procedure until the determination is made that the tape 31A has been fed by a predetermined amount.

Subsequently, the control circuit 37, in step S24, starts printing on the tape 31A while controlling the driving of the feeder 36 and the printing head 33 based on print data. That is, the control circuit 37 controls print dots based on whether the tape 31A facing the printing head 33 is raster data or a blank line, and executes processing in accordance with the non-printing or printing of each dot line by line.

Then, the control circuit 37, in step S25, determines whether or not the printing based on the above described print data has been completed. If printing has been completed (step S25: Yes), the flow proceeds to step S26. On the other hand, if printing has not been completed (step S25: No), the control circuit 37 continuously repeats this procedure.

Subsequently, the control circuit 37, in step S26, determines whether or not the timing is the aforementioned cut timing. In other words, the control circuit 37 determines whether or not the timing is the timing of the above described second dot pattern. Then, if the timing is the cut timing (step S26: Yes), the flow proceeds to step S27. On the other hand, if the timing is not the cut timing (step S26: No), the control circuit 37 continuously repeats this procedure.

Then, the control circuit 37, in step S27, stops the driving of the feeder 36 and the printing head 33, stops the printing on the tape 31A as well as the feeding, and the flow proceeds to step S28.

Then, the control circuit 37, in step S28, drives the full-cutter 34 (or the half-cutter 35) and cuts the tape 31A, completing this routine.

However, the present disclosure is not limited to the above described embodiment, and various modifications may be made without deviating from the spirit and scope of the disclosure. The following describes such modifications one by one.

(1) When the Cut is a Half-Cut Rather than a Full-Cut

While the above described embodiment has described an illustrative scenario in which the three print labels L are cut across the entire thickness in the thickness direction by the full-cutter 34 as in the case of the text character "A," the text character "B," and the text character "C," the present disclosure may also be applied to a half-cut, which is a partial cut in the thickness direction as described above.

(2) When the Cut Pattern Itself is Formed into Print on the Margin Side

In the aforementioned embodiment, a specific dot pattern (second dot pattern) determined in advance is included within the primary print data as a substitute for the cut command. Then, in step S11, the above described second print data is generated using the above described first dot pattern extracted from the primary print data. As a result, the above described specific dot pattern is not formed into print as is on the print label L to be produced based on the output from step S10.

Nevertheless, there are cases in which one print label L includes a location where the half-cutter 35 partially cuts (so-called half cuts) the tape 31A in the thickness direction, for example. In this case, when the produced print label L is used, the above described layers that have been cut of the tape 31A are sometimes peeled with the half-cutting location serving as the border (while leaving the above described layer that has not been cut). In such a case, for convenience of the above described peeling, forming some type of print at the above described cutting location makes the peeling location visually easier to understand and thus the peeling more convenient.

Hence, in this modification, in response to cases such as described above, the above described second dot pattern is formed in advance in a position shifted from the cutting location in the above described primary print data.

Then, according to the print data processing program, in a case where a non-print area (margin section) occurs on one side of the tape 31A in the transport direction from the cutting location by the full-cutter 34, in step S1, which serves as the primary print data acquiring procedure, the primary print data, which includes the above described second dot pattern in a position that is shifted to the non-print area side of the cutting position, is acquired. Subsequently, in step S11, which serves as the secondary print data generating procedure, the second print data wherein both the first dot pattern and the second dot pattern have been extracted is newly generated from the above described acquired primary print data. With this arrangement, print formation corresponding to the above described second dot pattern is performed on the print label L to be produced.

(3) When not Printing System Specific but Rather Label Producing Apparatus Specific While the above described embodiment has described an illustrative scenario in which the label producing apparatus 3 is operated to produce the print label L using the operation terminal 2 which is a personal computer, the present disclosure may also be applied to a so-called stand-alone type label producing apparatus, for example. In this case, the label producing apparatus 3 itself executes the function of the operation terminal 2. That is, in addition to each processing of the flow in FIG. 8, the label producing apparatus 3 executes processing equivalent to each processing of the flow in FIG. 6. Specifically, the control circuit 37 of the label producing apparatus 3, having a configuration other than the above described label producing part, executes the above described processing, thereby fulfilling a function equivalent to that of the above described operation terminal 2.

In this case, the function of the CPU 21 that executes the processing equivalent to the above described step S1 is equivalent to the primary print data acquisition portion described in each of the claims, the function of the CPU 21 that executes the processing equivalent to the above described step S11 is equivalent to the secondary print data generating portion described in each of the claims, the function of the CPU 21 that executes the processing equivalent to the above described step S5 is equivalent to the cut command generating portion described in each of the claims, and the function of the CPU 21 that executes the processing equivalent to the above described step S10 is equivalent to the data and command output portion described in each of the claims.

(4) When the Position of the Second Dot Pattern can be Changed

That is, on the above described editing screen, the user may arbitrary change the position of the second dot pattern by a suitable operation using the operation terminal 2. At this time, for example, the user can move the position in units of one dot along the column direction, which is the transport direction of the tape 31A, using the "Δ" keys with the apexes facing the left-right direction or the "←" "→" keys displayed on the editing screen, the "Δ" keys or "+" "−" keys provided as standard on the keyboard of a personal computer, or a touch operation on a touch-panel type liquid crystal display screen.

(5) Other

Further, while the above has described an illustrative scenario in which the tape 31A is wound around the reel member to constitute the tape roll 31, and the tape 31A is fed out from the tape roll 31, the present disclosure is not limited thereto. For example, the print label L may be produced by stacking (layering flat into a tray-like object, for example) a long flat or strip-shaped tape A or sheet (including a tape cut at a suitable length after the tape 31A wound into the tape roll 31 is fed out) in a predetermined storage part so as to form a cartridge, mounting this cartridge to the cartridge holder of the label producing apparatus 3, feeding the tape or sheet from the cartridge, performing printing, and then cutting the margin section.

Figure 8:
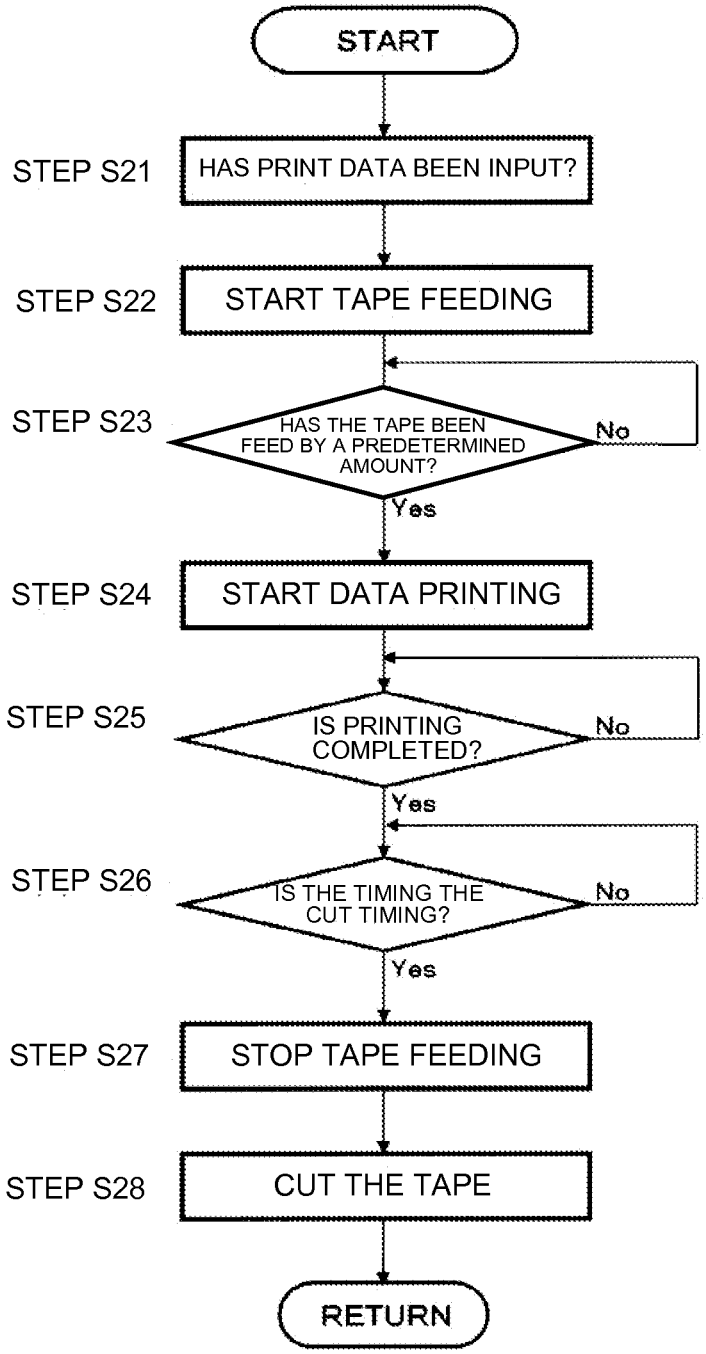
FIG. 8 is a flowchart showing the control procedure executed by the control circuit of the label producing apparatus.

Also note that the present disclosure is not limited to the procedures shown in the above described flows of the flowcharts in FIG. 6, FIG. 8, and the like, and procedure additions and deletions as well as sequence changes and the like may be made without deviating from the spirit and scope of the disclosure.

Further, other than that already stated above, techniques based on the above described embodiments and each of the modifications may be suitably utilized in combination as well.

Although other examples are not individually described herein, various changes can be made according to the present disclosure without deviating from the spirit and scope of the disclosure.

What is claimed is:

1. A non-transitory computer-readable recording medium storing a print data processing program for executing steps on a computing device configured to generate a signal for controlling a label producing part, the label producing part comprising a printing head configured to perform printing on a print-receiving tape, and a cutter configured to at least partially cut said print-receiving tape on which printing has been performed by said printing head in a thickness direction and to produce a print label, said steps comprising:

a primary print data acquiring step for acquiring primary print data that includes a first dot pattern indicating desired print contents to be formed by said printing head, and a second dot pattern indicating a cutting movement timing corresponding to a cutting location by said cutter;

a secondary print data generating step for newly generating second print data, wherein said first dot pattern has been extracted from said primary print data acquired in said primary print data acquiring step;

a cut command generating step for generating a cut command corresponding to said cutting movement timing indicated by said second dot pattern included in said primary print data acquired in said primary print data acquiring step; and a data and command outputting step for adding said cut command generated in said cut command generating step to said second print data generated in said secondary print data generating step, and for outputting a result to said label producing part.

2. The recording medium according to claim 1, wherein:

said printing head is a thermal head comprising a plurality of heating elements that are arranged along a direction orthogonal to a transport direction of said print receiving tape and are configured to form at least respective dots on respective printing lines, wherein said print-receiving tape is divided by print resolution in the transport direction, and said second dot pattern is a specific dot pattern expressed on one set of line printing data formed by means of dividing said primary print data into units of one of said printing lines.

3. The recording medium according to claim 2, wherein:

said steps further comprise a cut timing detecting step for analyzing said primary print data acquired in said primary print data acquiring step, for recognizing a specific dot pattern determined in advance as said second dot pattern in a case that said specific dot pattern is included in said primary print data and any dot patterns are not included in a predetermined range near said specific dot pattern in a transport direction, and for detecting said cutting movement timing corresponding to the specific dot pattern; and in said cut command generating step, said cut command is generated corresponding to said cutting movement timing detected in said cut timing detecting step.

4. The recording medium according to claim 1, wherein:

in a case that a non-print area occurs on one side of said print-receiving tape in a transport direction from a cutting location by said cutter during production of said print label, in said primary print data acquiring step, said primary print data that includes said second dot pattern in a position shifted farther to a side of said non-print area than said cutting location, is acquired; and in said secondary print data generating step, said second print data, wherein said first dot pattern and said second dot pattern have been extracted from said primary print data acquired in said primary print data acquiring step, is newly generated.

5. The recording medium according to claim 1, wherein:

said second dot pattern is a specific dot pattern that can be changed in position in units of one dot on one set of line printing data.

6. A print data processing method executed by an operation terminal configured to operate a label producing part, the label producing part comprising a printing head configured to perform printing on a print-receiving tape, and a cutter configured to at least partially cut said print-receiving tape on which printing has been performed by said printing head in a thickness direction and to produce a print label, comprising:

a primary print data acquiring step for acquiring primary print data that includes a first dot pattern indicating desired print contents to be formed by said printing head, and a second dot pattern indicating a cutting movement timing corresponding to a cutting location by said cutter;

a secondary print data generating step for newly generating second print data wherein said first dot pattern has been extracted from said primary print data acquired in said primary print data acquiring step;

a cut command generating step for generating a cut command corresponding to said cutting movement timing indicated by said second dot pattern included in said primary print data acquired in said primary print data acquiring step; and a data and command outputting step for adding said cut command generated in said cut command generating step to said second print data generated in said secondary print data generating step, and for outputting a result to said label producing part.

7. A label producing apparatus comprising:

a printing head configured to perform printing on a print-receiving tape;

a cutter configured to at least partially cut said print-receiving tape on which printing has been performed by said printing head in a thickness direction and to produce a print label;

a primary print data acquisition portion configured to acquire primary print data that includes a first dot pattern indicating desired print contents to be formed by said printing head, and a second dot pattern indicating a cutting movement timing corresponding to a cutting location by said cutter;

a secondary print data generating portion configured to newly generate second print data, wherein said first dot pattern has been extracted from said primary print data acquired by said primary print data acquisition portion;

a cut command generating portion configured to generate a cut command corresponding to said cutting movement timing indicated by said second dot pattern included in said primary print data acquired by said primary print data acquisition portion; and a data and command output portion configured to add said cut command generated by said cut command generating portion to said second print data generated by said secondary print data generating portion, and to output a result to said label producing part.

* * * * *